US006343431B1

(12) United States Patent
Brunn

(10) Patent No.: US 6,343,431 B1
(45) Date of Patent: Feb. 5, 2002

(54) GRENADE LAUNCHER ADAPTOR

(76) Inventor: Michael Brunn, 226 Newtown Rd., Plainview, NY (US) 11802

( * ) Notice: Subject to any disclaimer, the term of this patent is extended or adjusted under 35 U.S.C. 154(b) by 0 days.

(21) Appl. No.: 09/209,837

(22) Filed: Dec. 11, 1998

(51) Int. Cl.[7] ..... F41C 27/06
(52) U.S. Cl. ..... 42/105
(58) Field of Search ..... 42/105; 102/483; 403/368–371, 374.4, 351

(56) References Cited

U.S. PATENT DOCUMENTS

| | | | | | |
|---|---|---|---|---|---|
| 940,527 | A | * | 11/1909 | Hale | 102/483 |
| 1,797,194 | A | * | 3/1931 | Knapp | 403/370 |
| 3,243,909 | A | * | 4/1966 | Kotikov | 42/105 |
| 3,307,283 | A | * | 3/1967 | Cox | 42/105 |
| 3,318,033 | A | * | 5/1967 | Barr | 42/105 |
| 3,380,097 | A | * | 4/1968 | Pharris | 403/369 |
| 3,534,492 | A | * | 10/1970 | Amster | 42/105 |
| 3,690,026 | A | * | 9/1972 | Rose | 42/105 |
| 3,981,093 | A | * | 9/1976 | Reed | 42/105 |
| 4,202,644 | A | * | 5/1980 | Sousloff | 403/369 |
| 4,304,502 | A | * | 12/1981 | Stratienko | 403/370 |
| 4,615,640 | A | * | 10/1986 | Hosokawa | 403/369 |
| 4,930,242 | A | * | 6/1990 | Bialy | 42/105 |
| 5,811,713 | A | * | 9/1998 | Gudgel | 42/105 |

FOREIGN PATENT DOCUMENTS

| | | | | |
|---|---|---|---|---|
| FR | 492504 | * | 2/1920 | 42/105 |
| GB | 126692 | * | 5/1919 | 42/105 |
| IT | 563733 | * | 6/1957 | 42/105 |

* cited by examiner

*Primary Examiner*—Darren W. Ark
(74) *Attorney, Agent, or Firm*—Myron Amer P.C.

(57) ABSTRACT

A cylindrical adaptor with legs bounding an oversized compartment for a cylindrical firearm barrel to be used in launching a grenade, in which the oversize provides fitting clearance for a range of barrel sizes, and including a sleeve threadably engaged about the multi-furcated legs so that in response to the threading of the sleeve the legs are cammed together removing the fitting clearance and firmly attaching the adaptor to the firearm barrel.

1 Claim, 2 Drawing Sheets

GRENADE LAUNCHER ADAPTOR

The present invention relates to improvements in an adaptor component of a grenade launcher having a distal end for positioning and launching a grenade therefrom and a proximal end adapted to be attached in encircling relation about a cylindrical end of a firearm barrel, the improvements in the adaptor component, more particularly contributing to establishing the attachment of the proximal end of the grenade launcher to a myriad of shotguns and rifles having different barrel diameters.

EXAMPLE OF THE PRIOR ART

To enable a grenade launcher to be fitted to shotguns and rifles of varying barrel diameters, the launcher is provided with a so-called adaptor, one of which is exemplified by the adaptor illustrated and disclosed in U.S. Pat. No. 3,534,492 issued to S. A. Amster for "Firearm Grenade Launching Attachment" on Oct. 20, 1970. In the '492 patent, the sizing of differing diameters, namely that selected for the adaptor, and that of the weapon barrel, so that an interconnection result is achieved using spring clamps. This sizing technique, as well as those of all other known prior patents, does not provide as firm an attachment as is possible and also is limited to the range of weapon barrel diameter sizes that can be accommodated.

By way of background, the inventive adaptor is, in practice, dimensioned to accept barrels having diameters in the range of Ø0.790"–Ø0.950" and sights that are up to 0.400" wide that do not protrude beyond a Ø1.375" diameter. These dimensions were chosen so the adaptor would fit all Mossberg 500 series and Remington 870 series shotguns popular with law enforcement agencies and the M16 assault rifle used by the military. But it will be understood that not only will the adaptor fit perfectly the weapons noted because of its embodiment of dimensions intended to achieve this end result, but it will also fit just as perfectly weapons not noted and having barrel diameters outside the range noted. To this end, the adaptor is constructed to modify its weapon barrel-accommodating construction so as to accommodate weapons both as a result of its built-in dimensions and also as a result of modification of its built-in dimensions, all as will be better understood as the description proceeds.

Broadly, it is an object of the present invention to provide an adaptor-embodied grenade launcher overcoming the foregoing and other shortcomings of the prior art.

More particularly, it is an object to embody an operating mode in the adaptor component of the grenade launcher that initially provides a fitting clearance to facilitate the fitting of the grenade launcher on a weapon muzzle or barrel, and subsequently readily closes down the fitting clearance and achieves in its place a firm attachment to the weapon barrel. In this regard, the extent or size of fitting clearance contributes to the breadth of the range of weapon barrel diameters that can be accommodated.

The description of the invention which follows, together with the accompanying drawings should not be construed as limiting the invention to the example shown and described, because those skilled in the art to which this invention appertains will be able to devise other forms thereof within the ambit of the appended claims.

Figure 3A:
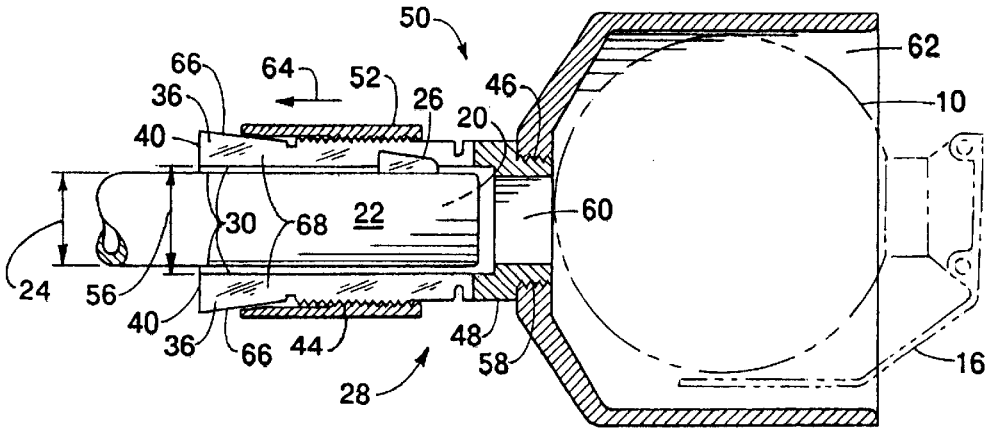
FIG. 3A is a sectional view as taken along line 3—3 of FIG. 2 showing a starting condition of threadably engagable components of the grenade launcher.
Figure 3B:
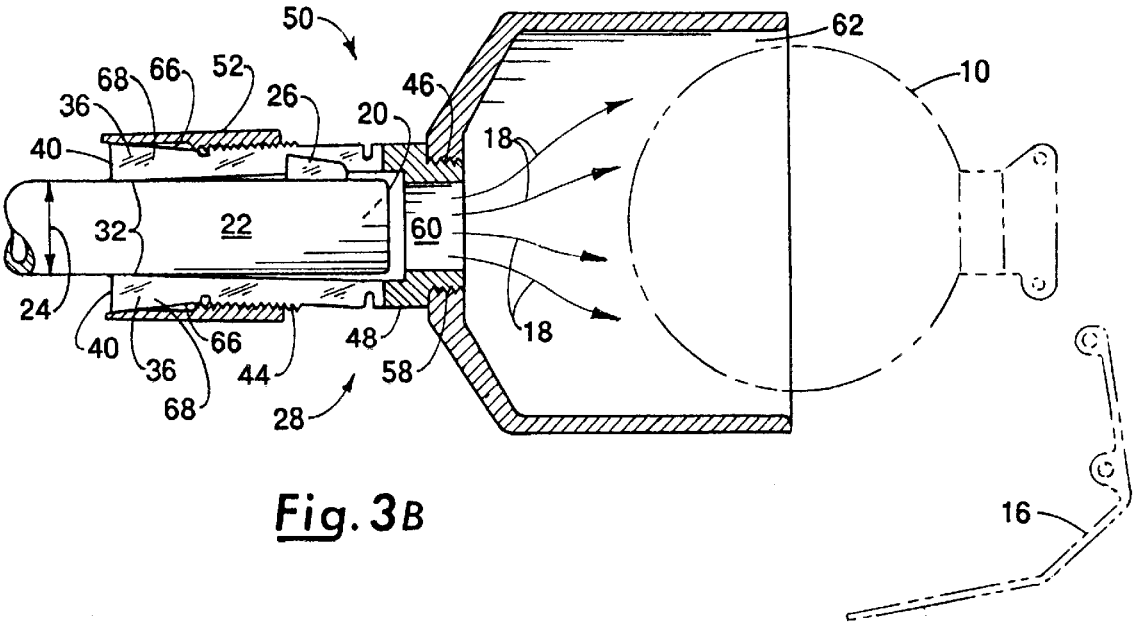
FIG. 3B is a view similar to FIG. 3A but showing a subsequent condition of said threadably engagable components.

It is known by common experience that it is common for law enforcement agencies and the military to launch hand grenades of all types from rifles and shotguns, as respectively exemplified by grenade 10 from firearm 12. This is accomplished by attaching a cup 14 to the muzzle end of the weapon 12. The cup 14 is sized to accommodate the specific grenade 10 desired to be launched and holds the grenade lever 16 captive when the grenade 10 is inserted into the cup 14, as depicted in FIG. 3A. A blank cartridge (not shown) is fired and the expanding gases 18 travelling through an end 20 of a cylindrical firearm barrel 22 propel the grenade 10, as depicted in FIG. 3B, to distances greater than those achievable by hand.

Since there are a myriad of shotguns and rifles in use, many having different barrel diameters as denoted at 24 and sighting systems as denoted at 26 and consequently, the launchers often have to be specifically adapted to the weapon. The "universal" type of launchers are usually designed to fit a popular weapon perfectly and other weapons imperfectly. The art addresses this problem by providing a so-called adaptor, to interconnect the cup 14 to the firing end 20 of the firearm 12, one such prior art adaptor being described and illustrated in U.S. Pat. No. 3,534,492 issued to S. A. Amster for "Firearm Grenade Launching Attachment" on Oct. 20, 1970, and which uses spring clamps to achieve the desired attachment of the cup 14 to the firearm barrel 22. Differing from the adaptor of the '492 patent and those of all other known prior patents is the adaptor, herein generally designated 28, which is characterized by having a fitting clearance 30 to facilitate positioning, as best illustrated in FIG. 3A and subsequently eliminating this clearance 30 to the end of achieving a firm interconnection, as at 32, to the firearm barrel 22, as best illustrated in FIG. 3B, and as will be better understood as the description proceeds.

It will be understood that the inventive adaptor 28 is of metal construction material and has a cylindrical body 34 in which at a selected number of circumferentially spaced apart locations, being 4 in number and spaced apart approximately 90 degrees in the illustrated embodiment, there is at each location walls, individually and collectively designated 36 in facing relation to each other and bounding therebetween slots, individually and collectively designated 38. Additionally, between there are adjacent slots 38 legs, individually and collectively designated 40 bounding a diameter 56. It should be noted that the slots 38 enable a flexuring resulting in a radial diminishment of the diameter 56 as a result of axial movement in the direction 42 by the barrel-engaging legs 40. Completing the adaptor 28 are external threads 44 and threads 46 at its distal end 48.

Figure 1:
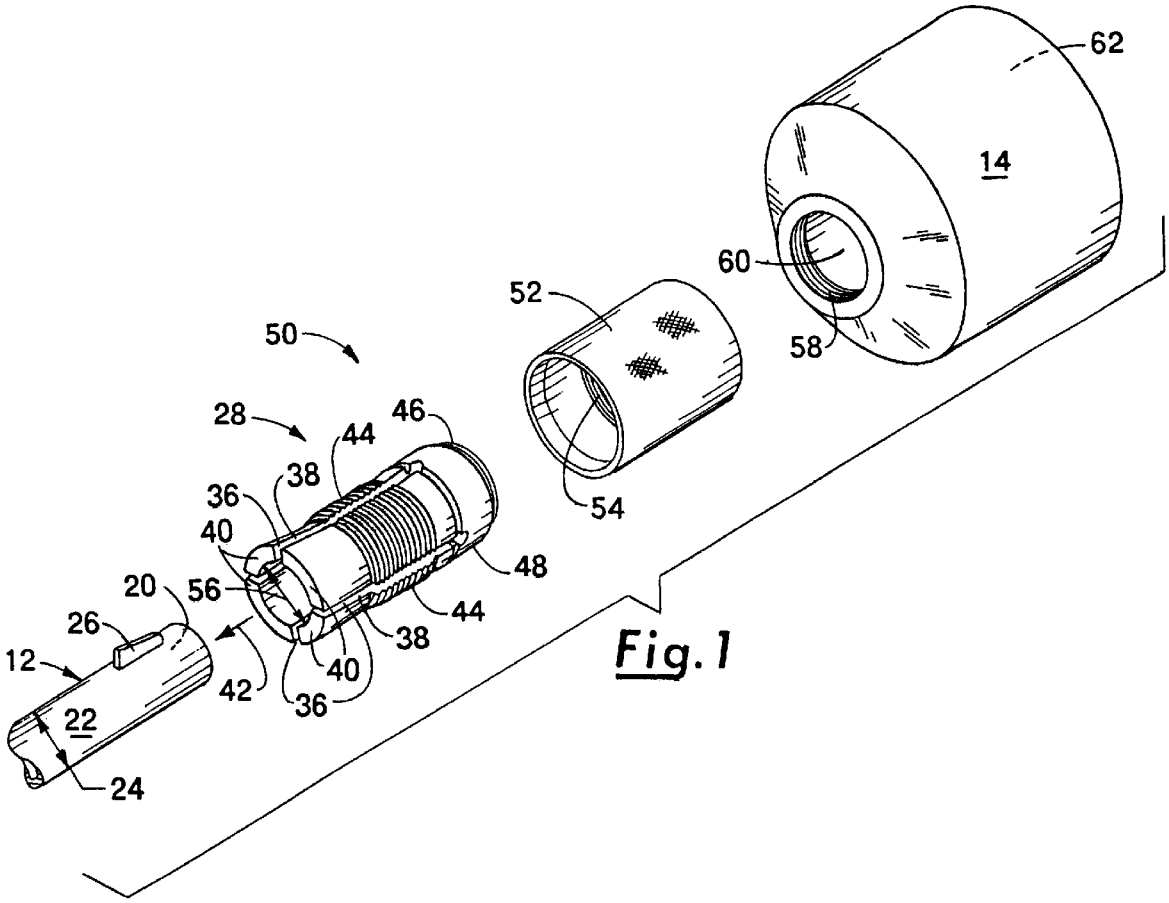
FIG. 1 is an exploded perspective view of the components in disassembled relation of a grenade launcher having the within inventive adaptor component.
Figure 2:
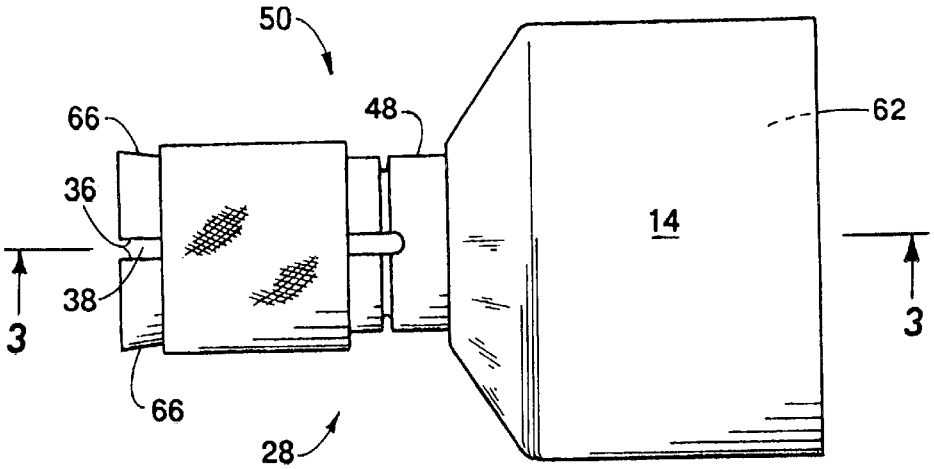
FIG. 2 is an assembled side elevational view of the grenade launcher.

To better understand how to assemble the grenade launcher 50 to the firearm 12 reference should be made to FIG. 1. Sleeve 52 is threadably engaged by internal threads 54 to the adaptor external threads 44, to assume positions relative to each as depicted in FIG. 3A. The diameter 56 at the proximal end of the adaptor is slightly oversized with respect to the outside diameter 24 of the firearm barrel 22 to a selected extent, so as to provide the noted fitting clearance 30 which facilitates the positioning of the firearm end 20 within the adaptor proximal end 56, during which positioning the sight 26 is disposed in a slot 38. It is important to note that the clearance 30 facilitates the attachment of the grenade launcher 50 to the firearm 12, and also has the utility of enabling the grenade launcher 50 to be attached to a range of diameters of firearm barrels as permitted by the extent of the clearance, said clearance in turn being a function of the size differences of the diameters 24 and 56.

Optionally, either prior to the assembly of the adaptor 28 or subsequently thereto, the external threads 46 are threadably engaged to internal threads 58 about an inlet opening 60 into the compartment 62 of the cup 14.

Next in the assembly of the grenade launcher 50 to the firearm barrel 22, sleeve 52 is rotated in an appropriate direction to move the sleeve 52 in a lengthwise direction 64 along the adaptor 28 to the position depicted in FIG. 3B. During such movement 64, the sleeve 52 contacts inclined cam surfaces, individually and collectively designated 66, of wedge configurations 68 provided on the adaptor distal end 48 in encircling relation about the firearm barrel 22. As a consequence, the barrel-engaging legs 40 are cammed in radically directed movement into firm contact and engagement to the firearm barrel 22.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In combination, a grenade launcher, an adapter and a firearm barrel of a cylindrical shape of a specified outside diameter having an aiming sight thereon, said grenade launcher having a distal end for positioning and firing a grenade therefrom and a proximal end having an operative position attached in encircling relation about said firearm barrel, said adapter providing said operative position of said grenade launcher on said firearm barrel comprising a cylindrical body having a longitudinally oriented wall bounding an inner cylindrical bore of a diameter slightly oversized with respect to said outside diameter of said firearm barrel and having in projected relation said firearm barrel within said inner cylindrical bore as permitted by a fitting clearance provided by said diameter size differences of said firearm barrel and said inner cylindrical bore, at select circumferential locations in said adapter cylindrical body a cooperating pair of adjacent walls bounding therebetween an open ended positioning slot and having delimited by and between said slots barrel-engaging legs, an externally threaded length portion along said adapter cylindrical body adjacent an end of each said slot, a hollow sleeve having an internally threaded length portion having an operative position disposed in encircling relation about said adapter cylindrical body and said internal and external threaded length portions thereof in threaded engagement with each other, and an operative position of said aiming sight in one of said positioning slots in an interposed position between said spaced apart walls thereof, whereby movement of said sleeve in the direction of said threading is adapted to cam said barrel-engaging legs radially inwardly so as to simultaneously remove said fitting clearance to establish attachment of said grenade launcher to said firearm and to said aiming sight thereon.

* * * * *